US007372409B2

(12) United States Patent
Morton

(10) Patent No.: US 7,372,409 B2
(45) Date of Patent: May 13, 2008

(54) SLIT LOADED TAPERED SLOT PATCH ANTENNA

(75) Inventor: Jacob Morton, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 244 days.

(21) Appl. No.: 11/358,146

(22) Filed: Feb. 21, 2006

(65) Prior Publication Data

US 2007/0194999 A1 Aug. 23, 2007

(51) Int. Cl.
*H01Q 1/38* (2006.01)

(52) U.S. Cl. ..... 343/700 MS; 343/767

(58) Field of Classification Search ..... 343/700 MS, 343/767, 770, 846, 848, 795
See application file for complete search history.

(56) References Cited

U.S. PATENT DOCUMENTS 6,424,309 B1 * 7/2002 Johnston et al. ..... 343/767
6,429,819 B1 8/2002 Bishop et al.
2004/0066345 A1 * 4/2004 Schadler ..... 343/767
2007/0046554 A1 * 3/2007 Fukuchi ..... 343/767
2007/0080878 A1 * 4/2007 McLean ..... 343/725

OTHER PUBLICATIONS

Chen, Zhi Ning, "Center-Fed Microstrip Patch Antenna", IEEE Transactions on Antennas and Propagation, vol. 51, No. 3, Mar. 2003.

* cited by examiner

*Primary Examiner*—Hoanganh Le
(74) *Attorney, Agent, or Firm*—Darby & Darby; Robert J. Sacco

(57) ABSTRACT

Patch antenna (100) for a wireless communications device has a reduced size. The patch antenna is operable on a fundamental frequency $f_0$ and a first harmonic $f_1$ of the fundamental frequency, with substantially co-located peak gain directions on both frequencies. The patch antenna (100) is formed from a conductive ground plane (102) of generally rectangular shape. A first aperture (108) provided in the conductive ground plane member (102) defines a bow-tie shape. Additional elongated apertures (118, 120) are provided for reactive loading. The elongated apertures (118, 120) disrupt the phasing of surface currents within the conductive ground plane member (102) around the periphery of the first aperture (108).

20 Claims, 7 Drawing Sheets

SLIT LOADED TAPERED SLOT PATCH ANTENNA

STATEMENT REGARDING FEDERALLY SPONSORED RESEARCH OR DEVELOPMENT

This invention was made with government support. The government has certain rights in the invention.

BACKGROUND OF THE INVENTION

1. Statement of the Technical Field

The inventive arrangements relate generally to slot antennas, and more particularly to tapered slot patch antennas.

2. Description of the Related Art

Patch antennas are very popular due to their compact planar configuration. In its simplest form, a microstrip patch antenna consists of a radiating patch on one side of a dielectric substrate, which has a ground plane on the other side. Despite the relatively narrow bandwidth of many patch antenna designs, they are well suited for many applications. Various modifications can be included in patch antennas to increase their overall bandwidth. One such broadband antenna design is the bow-tie antenna that consists of two triangular patches that are fed either through a pair of microstrip lines on their surface or by lines originating on different conductor layers.

Printed slot antennas comprise a slot in the ground plane of a grounded substrate. The shape of the slot can be selected so to conform to the shape of many designs normally associated with common microstrip patch antennas. For example, conventional slot antenna designs include rectangular slots, annular slots, and tapered slots. Slot antennas are generally bidirectional radiators. They radiate electromagnetic energy in opposing sides of the surface in which the slot is formed. Radiation in a single direction is commonly achieved by using a reflector plate on one side of the slot. Microstrip slot antennas are advantageous in that they can potentially offer bandwidths that are somewhat larger as compared to ordinary patch antennas.

Tapered slot antennas are also known in the art. For example, U.S. Pat. No. 6,429,819 to Bishop, et al. discloses a dual band bow-tie shaped slot antenna. Bow-tie antennas are also discussed in an article entitled Center-Fed Microstrip Patch Antenna, Zhi Ning Chen and Michael Yan Wah Chia, IEEE Transactions on Antennas and Propagation, Vol. 51, No. 3, March 2003, p. 483. The bow-tie shaped slot antenna generally consists of two triangular shaped slot elements which converge at the points of the triangles to form a narrow gap. The bow-tie shaped slot is etched into a conductive patch surface. The two bands are fed with a single antenna feed attached across a gap between the midpoints of the converging region of the bow-tie segments. Alternative feeds are known in the art. The low band frequency of operation in such an antenna is defined by a dimension of the conductive surface in which the slot is etched. The higher band frequency of operation is primarily determined by the dimensions of the bowtie slot.

Although the bow-tie slot antenna is relatively compact, there is a continuing demand for devices that offer multiband performance in smaller packages. Further, there is a continuing need for antennas of this type that offer high gain on multiple frequency bands while providing similar radiation patterns at the two different frequency bands. Providing all of these characteristics in a very compact package can be a challenging problem.

SUMMARY OF THE INVENTION

The invention concerns a patch antenna for a wireless communications device. The antenna can be operable on a fundamental frequency and a first harmonic of the fundamental frequency, with substantially co-located peak gain directions on the fundamental frequency and the first harmonic of the fundamental frequency. The patch antenna can also have the same polarization on the fundamental frequency and the first harmonic of the fundamental frequency.

The patch antenna is formed from a conductive ground plane member. The conductive ground plane member can have a generally rectangular shape. A first aperture provided in the conductive ground plane member can include a first tapered portion and a second tapered portion. Each of the first and second tapered portions respectively has opposing tapered edges that generally converge along a direction toward a central axis of the aperture. A transverse edge connects the opposing tapered edges at a point along the opposing tapered edges that is distal from the central axis. The first aperture can further include a narrowed portion extending between the first and second tapered portions. The narrowed region can also have opposing channel edges that together define an RF feed point for the patch antenna. Overall, the first aperture defines a bow-tie shape.

The antenna also includes at least a second elongated aperture formed in the conductive ground plane. For example, the second elongated aperture can be provided to provide reactive loading and disrupt the phasing of surface currents within the conductive ground plane member around the periphery of the first aperture. According to one aspect of the invention, the second elongated aperture can have a generally rectangular shape. The second elongated aperture can also define an elongated edge. The elongated edge can be positioned adjacent to one of the transverse edges formed by the first aperture. Further, the elongated edge of the second elongated aperture can be aligned with the transverse edge of the first aperture. In any case, the elongated aperture can be separated from the transverse edge of the first aperture by a gap defined by a portion of the conductive ground plane. A third elongated aperture similar to the second elongated aperture can also be provided respectively along a second one of the transverse edges.

One or more of the dimensions of the rectangular shape defining the conductive ground plane member can be selected for producing a first resonant frequency characteristic of the antenna. Advantageously, the dimension for producing the first resonant frequency can be reduced by the presence of the second elongated aperture as compared to the same dimension without the second elongated aperture.

The conductive ground plane member can be disposed on a first side of a substantially planar dielectric element. Further, a second conductive ground plane member can be disposed on a second side of the substantially planar dielectric element opposed from the first side. The second conductive ground plane member can act as a reflector for the antenna.

Advantageously, the patch antenna can have a first electrical resonant frequency characteristic on a fundamental frequency band and a second electrical resonant frequency characteristic on a first harmonic of the fundamental frequency band. For example, the first and second electrical resonant frequency characteristic can include an input feed point return loss magnitude greater than about 10 dB. Alternatively, or in addition thereto, the first and second electrical resonant frequency characteristic can be a peak antenna gain along an antenna boresight direction. Further, a gain of the antenna within the fundamental frequency band can be within about 3 dB of a second gain at the first harmonic frequency band at each antenna azimuth angle, within a predetermined range of angles around antenna boresight. The antenna can also have the same polarization on the fundamental frequency band and the first harmonic frequency band.

DETAILED DESCRIPTION OF THE PREFERRED EMBODIMENTS

Figure 1:
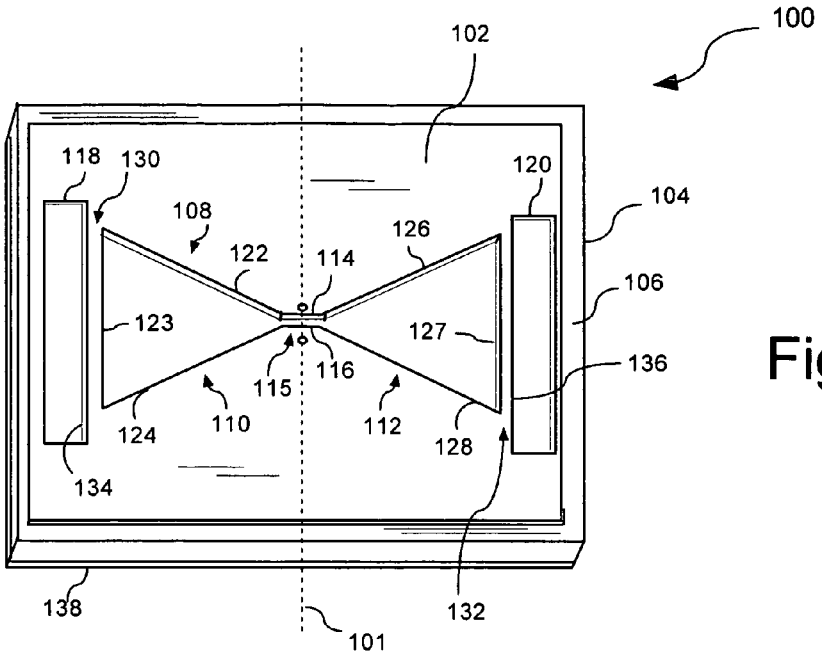
FIG. 1 is a perspective view of a slit loaded tapered slot patch antenna that is useful for understanding the invention.

The present invention concerns a patch antenna 100 for a wireless communications device. The antenna can be used for both transmitting and receiving purposes Referring to FIGS. 1-5, it can be observed that the patch antenna 100 is formed from a conductive ground plane member 102. The conductive ground plane member 102 can have a generally rectangular shape. A first aperture 108 is provided in the conductive ground plane member 102 and generally defines a bow-tie shape.

The first aperture can include a first tapered portion 110 and a second tapered portion 112. Each of the first and second tapered portions 110, 112 respectively has opposing tapered edges 122, 124, 126, 128, that generally converge along a direction toward a central axis 101. Transverse edges 123, 127 respectively connect the opposing tapered edges 122, 124, 126, 128 at a point along the opposing tapered edges that is generally distal from the central axis 101. The first aperture 108 can further include a narrowed region 115 which generally extends between the first and second tapered portions 110, 112. The narrowed region 115 can also have opposing channel edges 114, 116 that together define an RF feed point for the patch antenna. As will be appreciated by those skilled in the art, bow-tie shaped first aperture 108 generally provides a broader bandwidth as compared to rectangular slot antenna designs.

Figure 2:
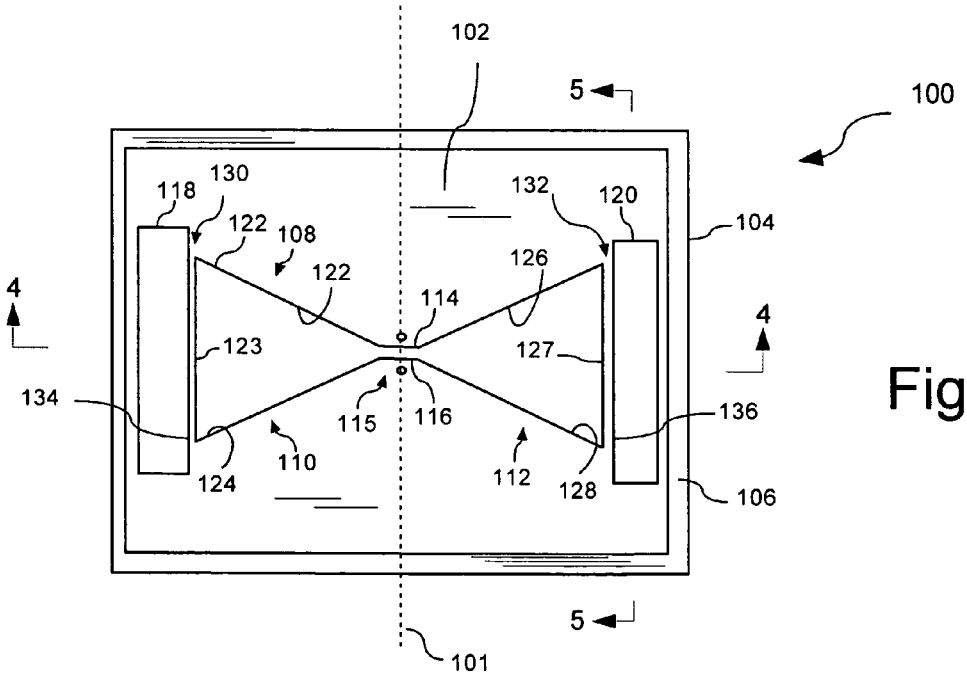
FIG. 2 is a top view of a slit loaded tapered slot patch antenna that is useful for understanding the invention.
Figure 3:
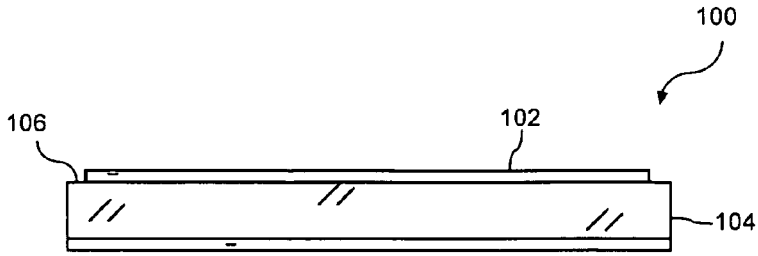
FIG. 3 is side view of the antenna in FIG. 1.
Figure 4:
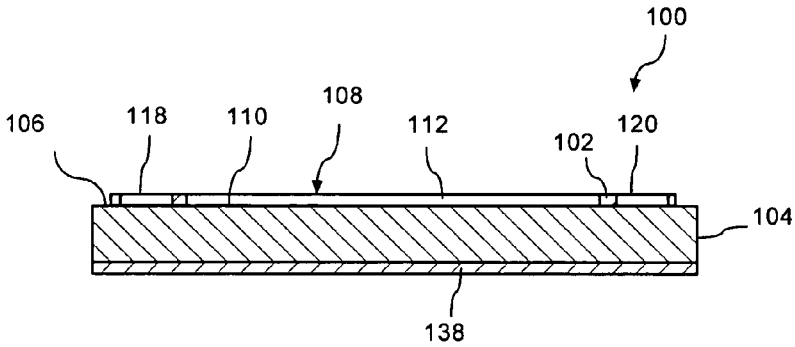
FIG. 4 is a cross-sectional view of the antenna in FIG. 1, taken along line 4-4.
Figure 5:
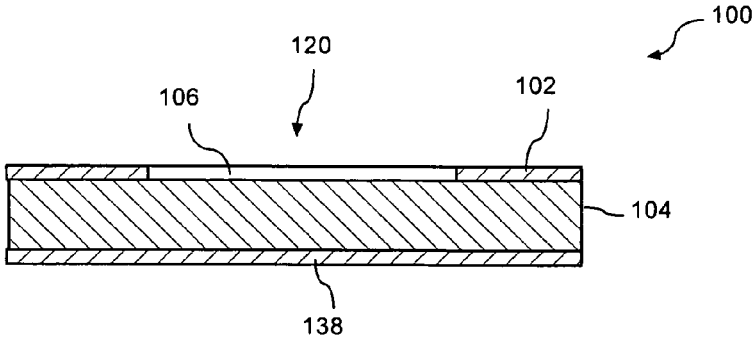
FIG. 5 is a cross-sectional view of the antenna in FIG. 1, taken along line 5-5.

The patch antenna 100 can also include a second elongated aperture 118 formed in the conductive ground plane 102. A third elongated aperture 120 can also be provided. The second and third elongated apertures 118, 120 can each have a generally rectangular shape as shown. The second and third elongated apertures can each respectively define an elongated edge 123, 127 as shown. The elongated edges 134, 136 can be positioned generally adjacent to respective ones of the transverse edges 123, 127 formed by the first aperture 108. Further, the elongated edges 134, 136 can be aligned with the transverse edges 123, 127 as illustrated in FIGS. 1 and 2. In any case, the elongated apertures 118, 120 can be separated from the transverse edges 123, 127 of the first aperture by a gap 130, 132 defined by a portion of the conductive ground plane 102.

The conductive ground plane member 102 can be disposed on a surface 106 of a substantially planar dielectric element 104. Further, a second conductive ground plane member 138 can be disposed on a second surface of the substantially planar dielectric element 104 opposed from the first side. The second conductive ground plane member can act as a reflector for the antenna.

The conductive ground plane member 102 can be formed of any suitable conductive material. For example, the conductive material can be a metal selected from the group consisting of copper, brass, aluminum, gold, or silver. Alternatively, the conductive ground plane can be formed from an alloy of these metals. Further still, the conductive ground plane can be formed from one or more of these metals plated with another metal.

The planar dielectric element 104 can be comprised of any suitable dielectric substrate material. Materials commonly used for this purpose include commercially available low and high temperature cofired ceramics (LTCC, HTCC). For example, low temperature 951 cofire Green Tape™ from Dupont® is Au and Ag compatible, has a acceptable mechanical properties with regard to thermal coefficient of expansion (TCE). Similar products are available from other manufacturers.

LTCC substrate systems commonly combine many thin layers of ceramic and conductors. The individual layers are typically formed from a ceramic/glass frit that can be held together with a binder and formed into a sheet. Conductors can be screened onto the layers of tape to form RF antenna elements and ground planes 102, 138 as described herein. Two or more layers of the same type of tape is then fired in an oven.

Other materials commonly used as dielectric substrates include Teflon® PTFE (PolyTetraFluoroEthylene) composites of glass fiber, woven glass and ceramics. Such products are commercially available from a variety of manufacturers. For example, Rogers Corporation of Chandler, Ariz. offers such products under the trade name RT/duroid including product numbers 5880, 6002, and 6010LM. Unlike LTCC materials, these types of substrates do not generally require a firing step before they can be used. Instead, they are typically provided in the form of rigid board material with a conductive metal ground plane formed on one or both sides. Consequently, the conductive ground plane member can be etched using conventional photolithographic techniques to form the outline of the conductive ground plane 102 and the various apertures 108, 118, 120.

Referring again to FIGS. 1 and 2, the RF feed point defined by the opposing edges of narrowed region 115 will now be discussed in further detail. According to one embodiment, the antenna feed connections are on opposing sides of the narrowed region 115. For example, a coaxial cable (not shown) can be used for this purpose. An inner conductor of the coaxial cable can form an electrical connection with the conductive ground plane at channel edge 114. A shield portion of the coaxial cable can form an electrical connection with the conductive ground plane at channel edge 116. Conventional soldering techniques can be used for this purpose. Other types of feed arrangements are also possible as will be appreciated by those skilled in the art. For example, a coupled microstrip feed, or a coupled parallel waveguide (CPW) feed could also be used for this purpose. Still, it should be understood that the invention is not limited to any particular type of feed arrangement.

The patch antenna 100 disclosed in FIGS. 1-5 is a significant improvement as compared to conventional bowtie/slot antenna designs. The second and third apertures 118, 120 define two additional slits as compared to conventional bow-tie antennas. As shown in FIGS. 1-5, a length of these slits can run generally transverse to opposing tapered edges 122, 124, 126, 128 and generally in parallel alignment to the transverse edges 123, 127. Second and third apertures 118, 120 provide reactive loading along the peripheral portion of antenna 100 along transverse edges 123, 127. The second and third apertures also provide a mechanism for effectively disrupting the phasing of surface currents.

There are several benefits of the arrangement described herein. For example, the loading technique associated with the use of the second and third apertures 118, 120 will reduce the physical size of the rectangular conductive ground plane member 102 as compared to the normal rectangular microstrip patch while operating at the same frequency. The patch antenna 100 also provides a solution that is capable of concurrently operating on two different frequency bands. Specifically, the antenna offers good performance at a fundamental frequency centered at a fundamental frequency $f_0$ and at a first harmonic frequency band centered about a first harmonic frequency $f_1$ (where $f_1=2f_0$). Advantageously, it also provides similar radiation patterns at the two different frequency bands. Notably, the peak gain is located on boresight for both frequency bands of operation and is of similar peak value. For example, a gain of the antenna within the fundamental frequency band can be within about 3 dB of a second gain at the first harmonic frequency band at each antenna azimuth angle, within a predetermined range of angles around antenna boresight. The patch antenna 100 also provides the same polarization on the fundamental frequency band and the first harmonic frequency band.

The addition of the second and third aperture 118, 120 running perpendicular to the opposing tapered 122, 124, 126, 128 is the mechanism that results in a reduction of the physical dimensions of the conductive ground plane 102 at the fundamental frequency. The size reduction occurs due to increased electrical length along the resonant dimension L1. The second and third apertures 118, 120 also have the benefit of disrupting surface currents so that the phasing at the first harmonic frequency band $f_1$ will add in phase along boresight instead of at an arbitrary elevation angle. This improvement centers the peak radiation of both frequency bands on boresight. In addition, the second and third apertures increase the cross polarization discrimination by approximately 8 dB at the first harmonic frequency $f_1$.

As noted above, the patch antenna 100 is operable on two separate frequency bands. Stated differently, this means that the patch antenna 100 can have a first electrical resonant frequency characteristic at the fundamental frequency band and a second electrical resonant frequency characteristic at the first harmonic frequency band. For example, the first and second electrical resonant frequency characteristic can include an input feed point return loss magnitude greater than about 10 dB on each of the two frequency bands.

Figure 6B:
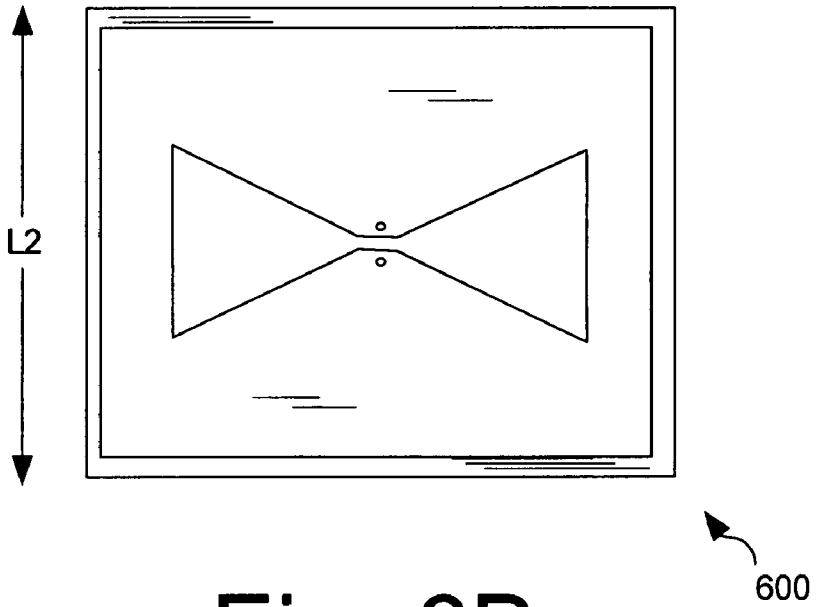
Fig. 6B (Prior Art)
FIG. 6 is a top view of the antenna in FIG. 1 and a conventional bow-tie slot antenna shown side-by side for comparison of certain characteristics.
Figure 6A:
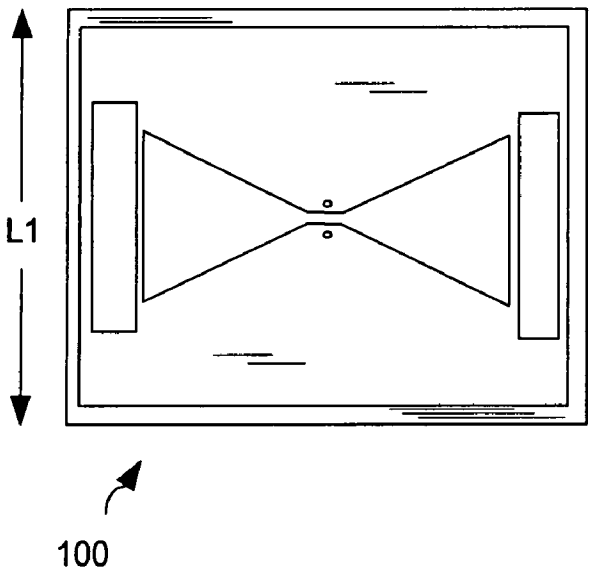

Referring now to FIGS. 6A and 6B there is shown patch antenna 100 and a conventional bow-tie slot patch antenna 600. In FIG. 6A, L1 is a resonant dimension of the patch antenna 100 that is useful for drawing size comparisons of patch antenna 100 as compared to the prior art. In FIG. 6A, the value L1 is approximately 0.28 λ at an operating frequency $f_0$. By comparison, the dimension of L2 for the conventional bow-tie antenna 600 in FIG. 6*b* which is designed for operating at the same frequency would be about 0.32, or about 13% larger. In a conventional rectangular patch antenna operating at the same frequency, the corresponding dimension would be approximately 0.4 λ, or about 43% larger. Thus, it can be seen that the patch antenna 100 provides a significant size reduction as compared to conventional antenna designs.

Figure 7:
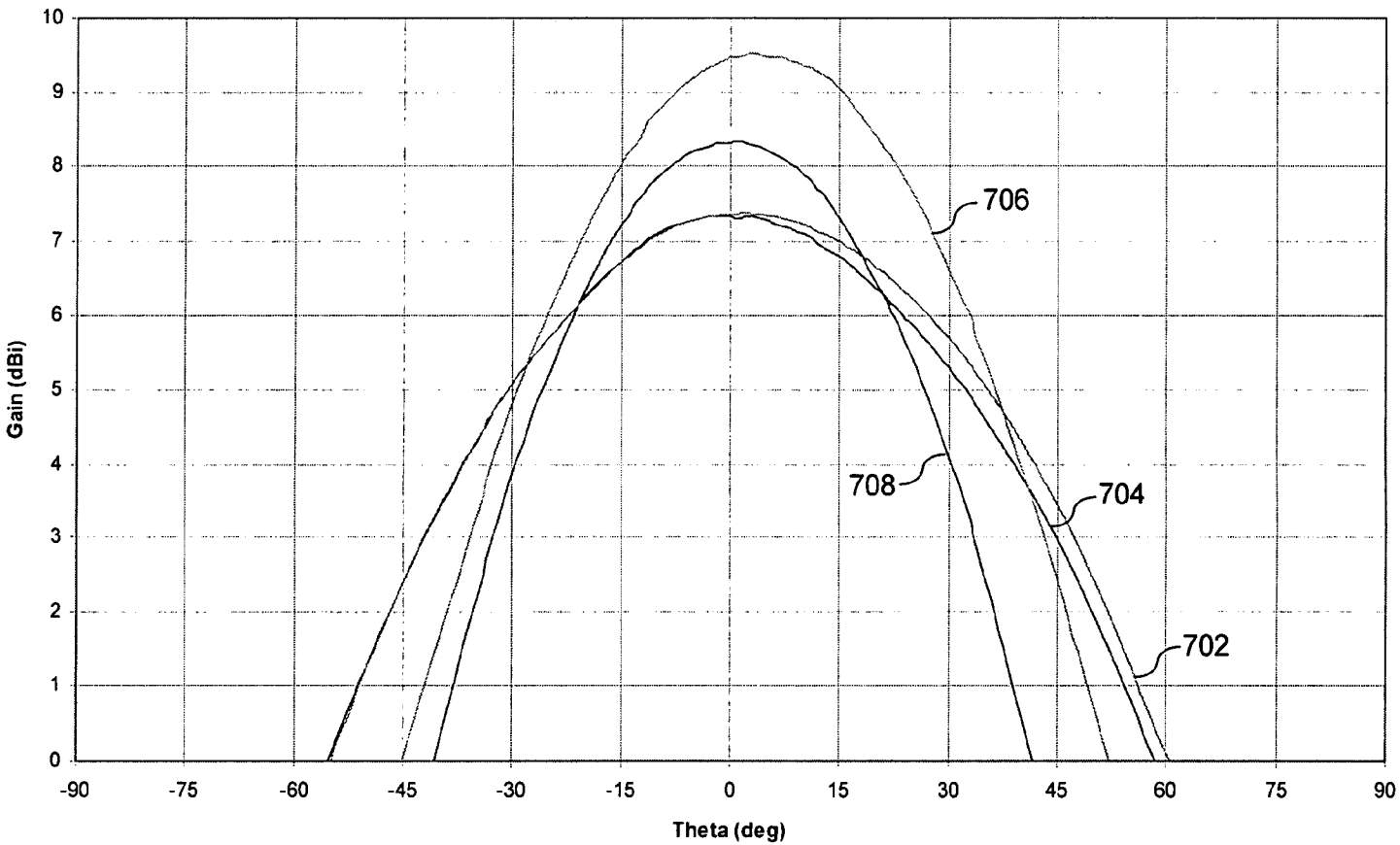
FIG. 7 is a set of plots comparing peak gain for a slit loaded tapered slot antenna and a conventional bow-tie slot patch antenna on a fundamental frequency and a first harmonic frequency.
Figure 8:
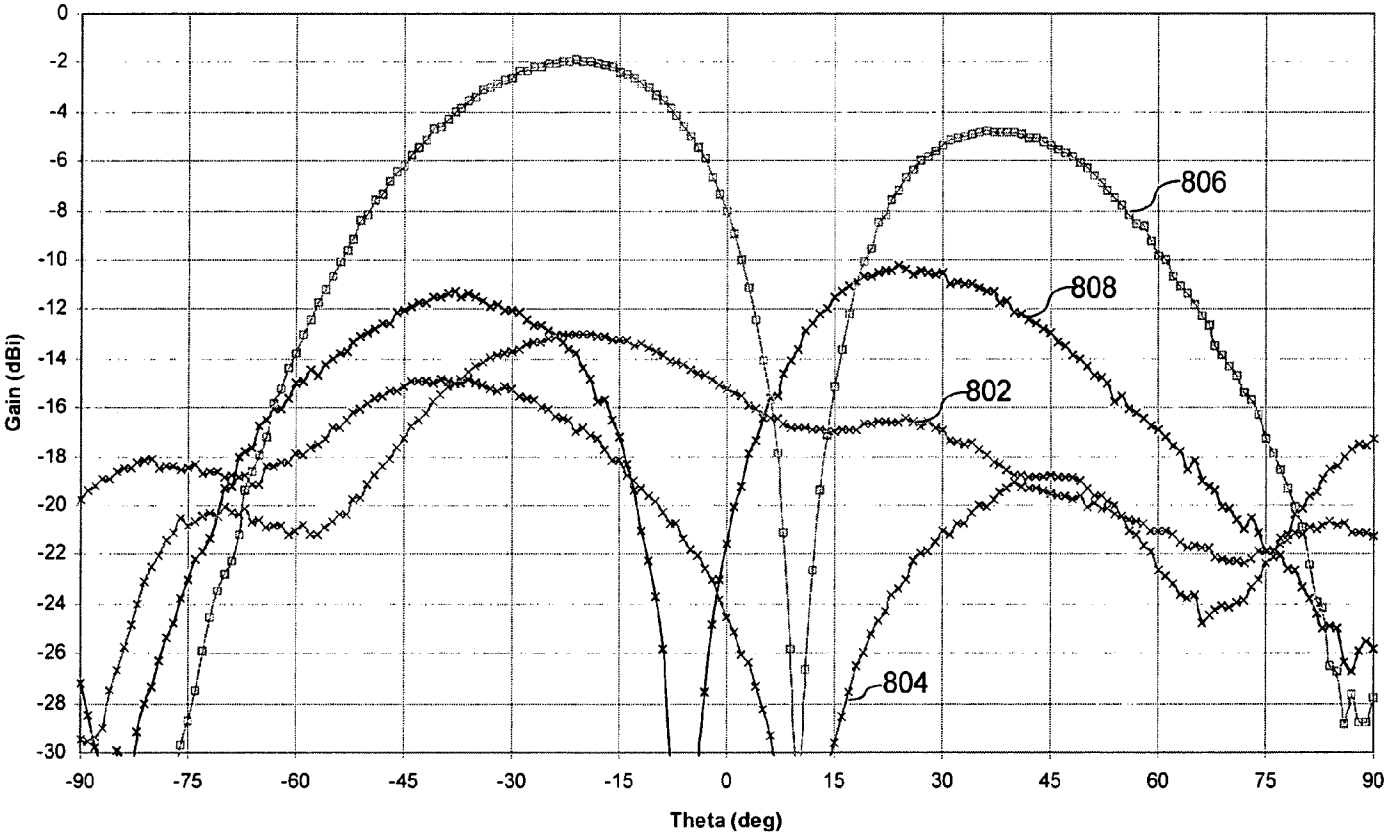
FIG. 8 is a set of plots comparing cross-polarization for a slit loaded tapered slot antenna and a conventional bow-tie slot patch antenna on a fundamental frequency and a first harmonic frequency.
Figure 9:
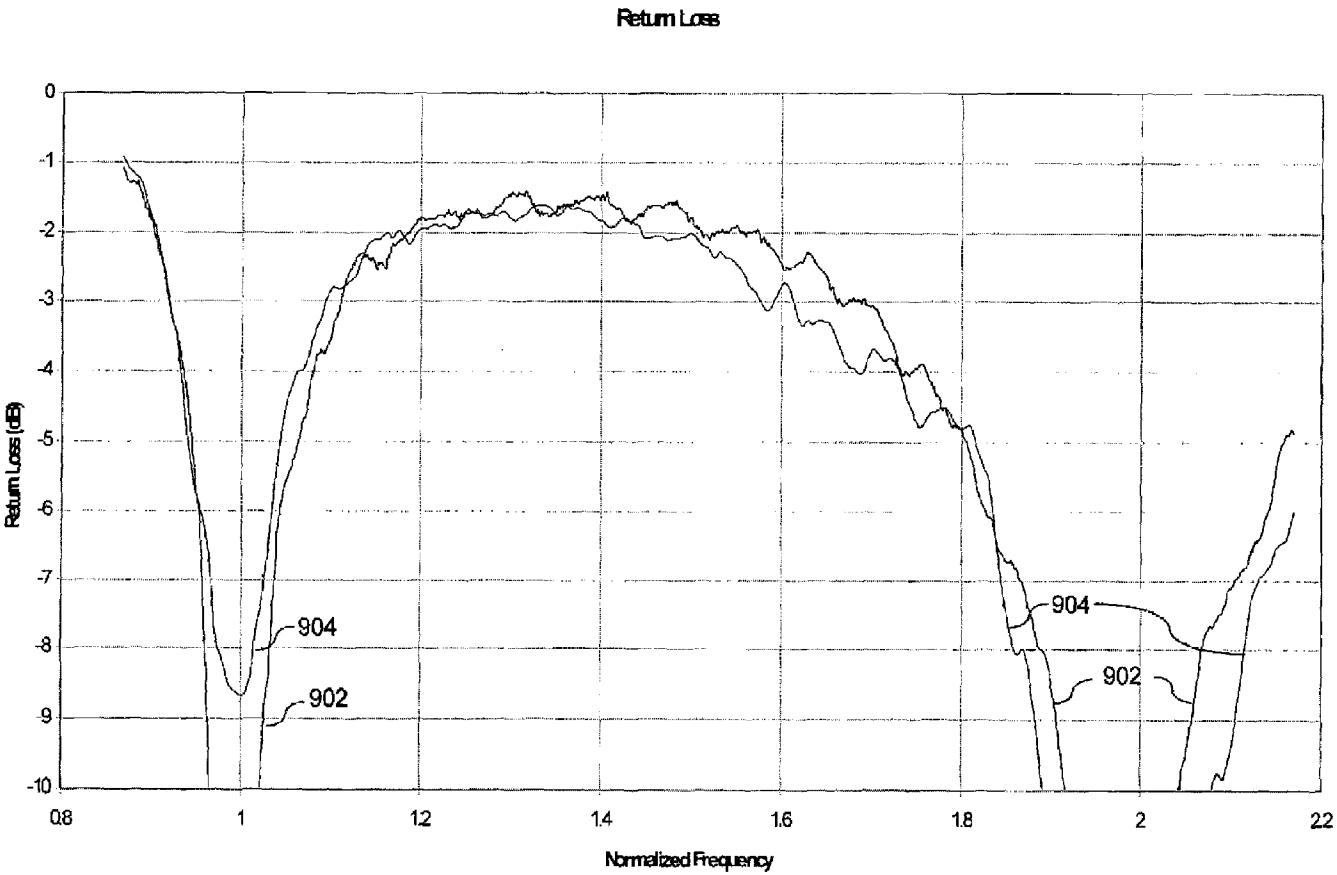
FIG. 9 is a set of plots showing return loss versus frequency for a slit loaded tapered slot antenna and a conventional bow-tie slot patch antenna.

FIGS. 7-9 are a set of plots generated by computer model. FIG. 7 shows a set of four plots that include peak gain for a slit loaded tapered slot antenna to a conventional bow-tie slot patch antenna on a fundamental frequency and a first harmonic frequency. Plot 702 shows the gain characteristics of a conventional bow-tie slot antenna at a fundamental frequency $f_0$. Plot 704 shows the gain characteristic for the patch antenna 100 at the same fundamental frequency. It may be noted that the gain characteristics of the two antennas are nearly identical at this frequency.

Plot 706 shows the gain characteristics of a conventional bow-tie slot antenna at a first harmonic $f_1$ of the fundamental frequency $f_0$. Plot 708 shows the gain characteristics of patch antenna 100 at the first harmonic $f_1$. It may be noted that the gain characteristics for the two antennas are similar, with the patch antenna 100 exhibiting a decrease in peak gain of only about 1.2 dB.

FIG. 8 is a set of plots comparing cross-polarization for patch antenna 100 and a conventional bow-tie slot antenna on a fundamental frequency $f_0$ and a first harmonic frequency $f_1$. Plot 802 shows the cross-polarization characteristics of a conventional bow-tie slot antenna at a fundamental frequency $f_0$. Plot 804 shows the cross-polarization characteristics of the patch antenna 100 at the same fundamental frequency $f_0$. Plot 806 shows the cross-polarization characteristics of a conventional bow-tie slot antenna at the first harmonic frequency $f_1$. Plot 808 shows the cross-polarization characteristic of the patch antenna 100 at the first harmonic frequency $f_1$. As can be observed in FIG. 7, the patch antenna 100 exhibits improved cross-polarization characteristics at the fundamental frequency $f_0$ in and around boresight. At the first harmonic frequency $f_1$, there is a further improvement in cross-polarization levels with the patch antenna 100. In general, peak cross-polarization shown by plot 808 is as much as 8 dB lower as compared to peak cross-polarization values for plot the conventional bow-tie antenna shown in plot 806.

FIG. 9 is a set of plots showing return loss versus frequency for a slit loaded tapered slot antenna and a conventional bow-tie slot patch antenna. Return loss of the conventional bow-tie slot patch antenna is shown in plot 902. Return loss for the patch antenna 100 is show in plot 904. The return loss for the patch antenna 100 is degraded slightly at the fundamental frequency fo as compared to the conventional bow-tie antenna. However, the return loss improves somewhat with the antenna 100 at the first harmonic frequency $f_1$.

Figure 10:
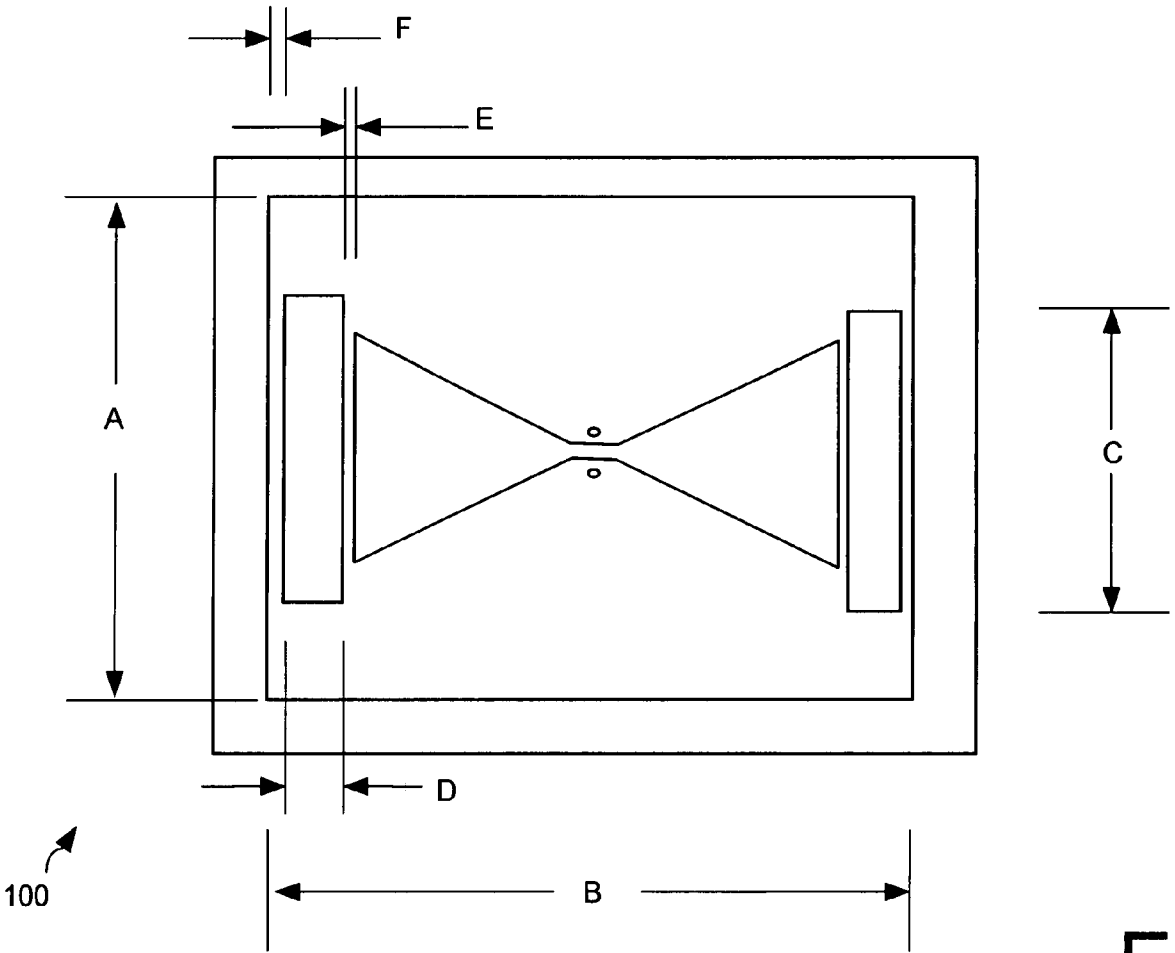
FIG. 10 is a drawing that is useful for understanding one possible set of dimensions that can be used when implementing the invention.

Referring now to FIG. 10, there is shown a diagram of a slit-loaded bow tie slot antenna diagram that is useful for understanding the invention. The diagram in FIG. 10 shows one possible set of dimensions that can be used in connection with the invention. The plots shown in FIGS. 7-10 were produced with a slit-loaded bow tie slot antenna having dimensions consistent with those shown in FIG. 10. The dimensions below are expressed in fractions of a wavelength at a resonant frequency of the device. Dimensions in fractions of wavelength are as follows:

A=0.29666 λ
B=0.39425 λ
C=0.18760 λ
D=03201 λ
E=0.01132 λ
F=0.00937 λ

Those skilled in the art will appreciate that the inventions provided herein are not intended to limit the invention. Other dimensions suitable for specific applications may also be determined based on experimental results or computer modeling.

The invention described and claimed herein is not to be limited in scope by the preferred embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

A number of references are cited herein, the entire disclosures of which are incorporated herein, in their entirety, by reference for all purposes. Further, none of these references, regardless of how characterized above, is admitted as prior to the invention of the subject matter claimed herein.

I claim:

1. A patch antenna for a wireless communications device, comprising:

a conductive ground plane member;

a first aperture provided in said conductive ground plane member including a first tapered portion and a second tapered portion, each of said first and second tapered portions respectively having opposing tapered edges that converge along a direction toward a central axis of said first aperture and a transverse edge connecting said opposing tapered edges at a point distal from said central axis, to define a bow-tie shape; and at least a second elongated aperture formed in said conductive ground plane, an elongated edge of said second elongated aperture positioned adjacent to said transverse edge and separated from said transverse edge by a gap defined by a portion of said conductive ground plane.

2. The patch antenna according to claim 1, wherein said conductive ground plane member has a generally rectangular shape.

3. The patch antenna according to claim 2, wherein at least one dimension of said rectangular shape is selected for producing a resonant frequency characteristic of said antenna, and said at least one dimension for producing said resonant frequency is reduced by the presence of said second elongated aperture as compared to without said second elongated aperture.

4. The patch antenna according to claim 1, wherein said second elongated aperture has a generally rectangular shape.

5. The patch antenna according to claim 1, wherein said elongated edge of said second elongated aperture is aligned with said transverse edge of said first aperture.

6. The patch antenna according to claim 1, wherein said conductive ground plane member is disposed on a first side of a substantially planar dielectric element.

7. The patch antenna according to claim 6, wherein a second conductive ground plane member is disposed on a second side of said substantially planar dielectric element opposed from said first side.

8. The patch antenna according to claim 1, wherein said first aperture further includes a narrowed portion extending between said first and second tapered portions.

9. The patch antenna according to claim 8, wherein said narrowed region has opposing channel edges that together define an RF feed point for said patch antenna.

10. The patch antenna according to claim 1, wherein said antenna has a first electrical resonant frequency characteristic on a fundamental frequency band and a second electrical resonant frequency characteristic on a first harmonic of said fundamental frequency band.

11. The patch antenna according to claim 10, wherein said first and second electrical resonant frequency characteristic comprise a characteristic selected from the group consisting of (1) an input feed point return loss magnitude greater than about 10 dB, and (2) antenna peak gain along an antenna boresight direction.

12. The patch antenna according to claim 10, wherein a gain of said antenna within said fundamental frequency band is within about 3 dB of a second gain at said first harmonic frequency band at each antenna azimuth angle within a predetermined range.

13. The patch antenna according to claim 10, wherein said antenna has the same polarization on said fundamental frequency band and said first harmonic of said fundamental frequency band.

14. A patch antenna for a wireless communications device, comprising:

a conductive ground plane member;

a first aperture provided in said conductive ground plane member including a first tapered portion and a second tapered portion, each of said first and second tapered portions respectively having opposing tapered edges that converge along a direction toward a central axis of said first aperture and a transverse edge connecting said opposing tapered edges at a point distal from said central axis, to define a bow-tie shape; and at least one disrupting aperture formed in said conductive ground plane respectively positioned adjacent to each of said transverse edges, each said disrupting aperture separated from said transverse edge by a gap defined by a portion of said conductive ground plane, wherein said disrupting aperture produces a reactive loading effect.

15. The patch antenna according to claim 14, wherein said conductive ground plane member has a generally rectangular shape.

16. The patch antenna according to claim 15, wherein at least one dimension of said rectangular shape is selected for producing a resonant frequency characteristic of said antenna, and said at least one dimension for producing said resonant frequency is reduced by the presence of said disrupting aperture as compared to without said disrupting aperture.

17. The patch antenna according to claim 14, wherein said patch antenna is operable on a fundamental frequency and a first harmonic of said fundamental frequency, with substantially co-located peak gain directions on said fundamental frequency and said first harmonic of said fundamental frequency.

18. The patch antenna according to claim 17, wherein a difference between a magnitude of said peak gain on said fundamental frequency and said first harmonic of said fundamental frequency is less than about 3 db.

19. A patch antenna for a wireless communications device, comprising:

a conductive ground plane member;

a first aperture provided in said conductive ground plane member including a first tapered portion and a second tapered portion, each of said first and second tapered portions respectively having opposing tapered edges that converge along a direction toward a central axis of said first aperture and a transverse edge connecting said opposing tapered edges at a point distal from said central axis, to define a bow-tie shape;

at least a second elongated aperture formed in said conductive ground plane, an elongated edge of said second elongated aperture positioned adjacent to said transverse edge and separated from said transverse edge by a gap defined by a portion of said conductive ground plane;

wherein said antenna is operable on a fundamental frequency and a first harmonic of said fundamental frequency, with substantially co-located peak gain directions on said fundamental frequency and said first harmonic of said fundamental frequency.

20. The patch antenna according to claim 19, wherein said antenna has the same polarization on said fundamental frequency and said first harmonic of said fundamental frequency.

* * * * *